US005655591A

United States Patent [19]

Knutson

[11] Patent Number: 5,655,591

[45] Date of Patent: Aug. 12, 1997

[54] TENSION ASSEMBLY FOR ROLLER DOOR

[75] Inventor: Perry W. Knutson, Lancaster, Wis.

[73] Assignee: Rite-Hite Corporation, Milwaukee, Wis.

[21] Appl. No.: 414,353

[22] Filed: Mar. 31, 1995

[51] Int. Cl.[6] ..... A47G 5/02

[52] U.S. Cl. ..... 160/265; 160/268.1

[58] Field of Search ..... 160/268.1, 265, 160/273.1, 270, 271, 272, 322, 264, 267.1

[56] References Cited

U.S. PATENT DOCUMENTS

| | | |
|---|---|---|
| 1,550,237 | 8/1925 | Beckman . |
| 3,180,401 | 4/1965 | Gambon et al. . |
| 3,460,602 | 8/1969 | Hugus . |
| 3,878,879 | 4/1975 | Manns . |
| 3,981,343 | 9/1976 | DeVito . |
| 4,252,172 | 2/1981 | Pommat et al. . |
| 4,690,194 | 9/1987 | Seuster . |
| 4,690,195 | 9/1987 | Taylor . |
| 4,887,660 | 12/1989 | Kraus . |
| 4,896,714 | 1/1990 | Ellis . |
| 4,976,302 | 12/1990 | Taylor . |
| 4,997,022 | 3/1991 | Klein . |
| 5,025,847 | 6/1991 | Mueller . |
| 5,048,588 | 9/1991 | Weishar et al. . |
| 5,078,197 | 1/1992 | Weishar . |
| 5,129,442 | 7/1992 | Warner . |
| 5,139,075 | 8/1992 | Desrochers . |
| 5,141,044 | 8/1992 | Hying et al. . |
| 5,222,541 | 6/1993 | Hornberger . |
| 5,271,448 | 12/1993 | Delgado . |
| 5,299,617 | 4/1994 | Hying et al. . |
| 5,353,859 | 10/1994 | Oltahfer et al. . |

FOREIGN PATENT DOCUMENTS

| | | |
|---|---|---|
| 3245009 | 6/1984 | European Pat. Off. . |
| 125217 | 11/1984 | European Pat. Off. . |
| 2556403 | 3/1985 | European Pat. Off. . |
| 1444017 | 4/1976 | United Kingdom . |
| 503774 | 4/1995 | United Kingdom . |

OTHER PUBLICATIONS

"Re–Coil Away Specifications"; M & I Door Systems Limited; Date unknown; 2 pages.

"'Re–Coil Away'Door System Installation Instructions"; M & I Door Systems, Ltd.; May 1991; 18 pages.

"M & I Door Systems Limited" Product Brochure; M & I Door Systems Limited; Date unknown; 4 pages.

"Rytec Breaks Away" Products Brochures; Rytec Corporation; 1992; 2 pages.

"Rapid Roll Doors: The Super–Fast Solution!"Products Brochure; Albany International; 1990; 8 pages.

"Marathon Spirit" Products Brochure; Marathon Door Division—ASI Technologies; 1991; 3 pages.

"RT Series" Product Brochure; Kelley Company, Inc. 1993; 2 pages.

"Kelley Door Selection Guide"; Kelley Company, Inc.; 1993; 16 pages.

"Speedor" Product Brochure; Hart; Date unknown; 2 pages.

*Primary Examiner*—Blair Johnson

[57] ABSTRACT

A tensioning assembly for use on a roller door, the roller door including a curtain windable on a roller for selectively blocking and unblocking a doorway above a floor surface, the tensioning assembly including: a drum attached to the roller for rotation therewith, a pulley disposed adjacent to the floor and also adjacent to a vertical edge of the curtain in the doorway blocking position; and a resilient member having a first end connected to the drum and a second end attached to a leading edge of the curtain, the resilient member passes around the pulley intermediate its first and second ends, and the resilient member is windable on the drum in an opposite sense to the winding of the curtain on the roller, the drum and resilient member are dimensioned relative to the roller and curtain to maintain a proportional stretch on the belt for all vertical positions of the curtain, thereby maintaining the curtain under tension at all times.

5 Claims, 6 Drawing Sheets

TENSION ASSEMBLY FOR ROLLER DOOR

FIELD OF THE INVENTION

The invention relates generally to industrial roll-up doors, and more particularly to an improved tensioning assembly for maintaining a curtain of the roll-up door in a taut condition.

BACKGROUND OF THE INVENTION

Roll-up doors are used in a variety of industrial applications, typically for the purpose of separating areas within a building, or closing off building entries from the outside. A typical roll-up door comprises a curtain (usually made of fabric) which is wound about a roller journaled for rotation above the doorway with which the roll-up door is associated. To close the door, the roller is rotated such that the curtain pays off of the roller to enclose the doorway. Conversely, the door is opened by reversing the direction of the roller and rolling the fabric curtain onto the roller. Such roller doors are typically either powered open and closed, or are powered open and allowed to fall closed by gravity.

When the roll-up door is placed over an exterior doorway of a building, provision must be made to prevent the fabric curtain from billowing due to wind being applied from the outside. Similarly, when the roll-up door is in place between different sections of a warehouse, there may be pressure differentials between these two sections, which may also cause billowing of the roll-up door if the door does not have provision to prevent this from happening. Such billowing may be problematic as it impedes door function and allows leakage around the door. One technique for preventing such billowing is providing a rigid or semi-rigid bottom bar across the leading edge of the door. Further, other straps extending across the width of the door may be disposed at other positions vertically along the door.

A further technique for preventing billowing of a roll-up door is to exert tensioning forces on the door to hold it taut and provide wind retention. Many of the existing systems for applying this type of tension to a roll-up door make use of a drive belt or other cable or rope having one end attached to the leading edge of the door (such as to a bottom bar), and a second end attached to a drum on the roller shaft. Drive belts are used primarily to pull on the leading edge of the door curtain to draw it closed. According to some existing designs, however, this drive belting is also used for applying tension to the curtain. The drive belting or other cable or rope usually passes over pulleys typically disposed in the side frames on either side of the door. Such tensioning assemblies also include an external moving or spring-loaded member which acts on the belting or cable to exert the tensioning force on the door. For example, a weight may be suspended from the cable or rope between its ends as in U.S. Pat. No. 5,222,541 to Hornberger. In that patent, the weight suspended from the rope also performs a counterbalancing function. In other devices, such as shown in U.S. Pat. No. 4,690,194 to Seuster, the external member tensioning the rope or cable is a leg spring which is disposed between a member fixed for rotation with respect to the roller and a drum upon which the belt is wound which rotates freely relative to the axis of the roller. In yet other examples, such as in U.S. Pat. No. 4,997,022 to Klein, a pulley over which the cable or rope passes is spring-loaded so as to maintain a tension on the strap as the door moves between its unblocking and blocking positions, thus maintaining tension on the curtain to which the strap is attached. Alternatively, other devices are employed wherein such belting is not used for door tensioning during travel, but the door is latched at the bottom in its blocking position and the roller is reversed to exert tension on the door in the closed position.

The exemplary prior art devices just described all require some external member (weights, spring-loaded tensioner, or latches) for the purpose of exerting tension either on the belting, cable or rope or directly on the door. However, such external members may be subject to wear or failure and may thus present maintenance problems or safety hazards. Further, these external members add cost and complexity to the door and may reduce reliability.

SUMMARY OF THE INVENTION

It is thus a primary aim of the present invention to provide an improved curtain tensioning assembly for a roll-up door as compared to those that have been used heretofore.

In accordance with that aim, it is a primary aim of the invention to provide a tensioning assembly that is of simple construction.

It is a related object to provide a tensioning assembly that realizes a reduction of parts as compared to previous assemblies.

It is a further related object to provide a tensioning assembly having enhanced safety.

It is a further object of the invention to provide a tensioning assembly that is of simple operation.

It is a related object to provide a tensioning assembly having a simple means for reassembly of a breakaway bottom bar following a breakaway condition.

In accordance with these and other objects of the invention, there is provided a tensioning assembly for use on a roller door, the roller door including a curtain of a given thickness which is windable on a roller of a given radius for selectively blocking and unblocking a doorway above a floor surface. The tensioning assembly includes a drum attached to the roller for rotation therewith. Also included is a bearing surface, illustratively a pulley, disposed adjacent to a vertical edge of the curtain in the doorway blocking position. A resilient member is provided having a first end connected to the drum and a second end attached to the curtain. The resilient member passes around the pulley intermediate its first and second ends, and the resilient member is windable on the drum in an opposite sense to the winding of the curtain on the roller. According to the invention, the drum and resilient member are dimensioned relative to the curtain and roller to maintain a proportional stretch on the belt for all vertical positions of the curtain. Accordingly, the curtain is maintained under tension at all times without the need for any external members to act upon the resilient member to hold it, and the curtain to which it is attached, under tension. Rather, the natural resiliency of the member, along with the proper dimensioning of the resilient member and drum is used to maintain tension on the belt and the attached curtain.

According to a preferred embodiment of the invention, the resilient member is a stretchable belt and the pulley around which the belt passes is movable between a tensioned and a tension-release position. In the tensioned position, the above-mentioned proportional stretch is maintained on the belt for all vertical positions of the curtain. When the pulley is moved to its tension-release position, the door may be moved to a position where the tension in the belt is minimal or zero. Providing a minimal tension for the belt may be advantageous in the situation where the tensioning assembly is used in combination with a breakaway bottom bar. To facilitate reassembly of the bottom bar, the pulley is moved to the tension-release position, and the door is moved to the position of minimal belt tension so that the bottom bar may be reassembled without undue effort.

BRIEF DESCRIPTION OF THE DRAWINGS

The invention will be described with a reference to certain preferred embodiments, as shown in the following drawings wherein.

DETAILED DESCRIPTION OF THE PREFERRED EMBODIMENTS

While the invention will be described with reference to the preferred embodiments, it will be obvious to those of ordinary skill in the art that variations of these preferred embodiments may be used and it is intended that the invention may be practiced otherwise than as specifically described herein. Accordingly this invention includes all modifications and equivalents encompassed within the spirit and scope of the invention as defined by the appended claims.

Figure 1:
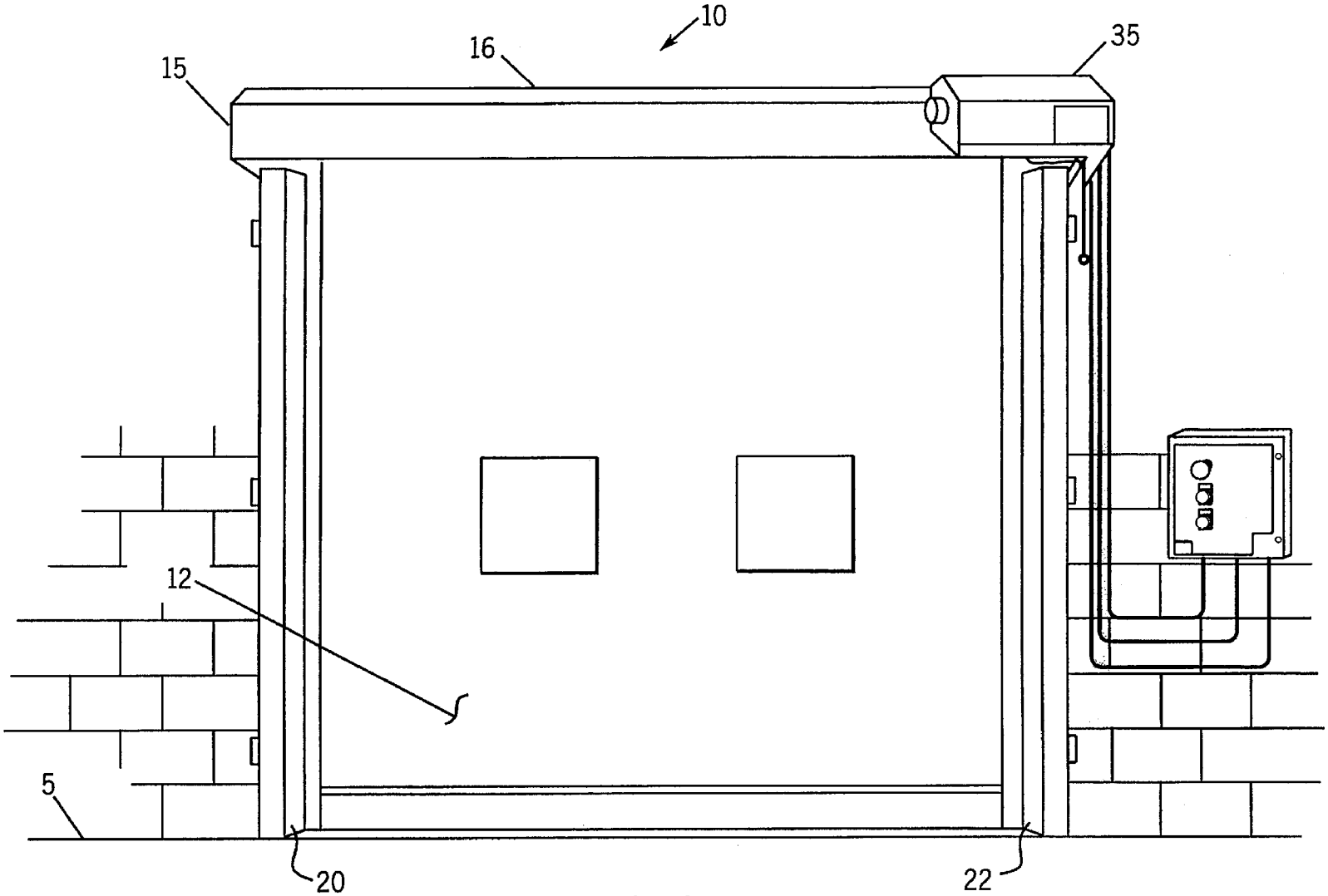
FIG. 1 is an elevation of a roller door employing or tensioning assembly according to the invention.
Figure 2:
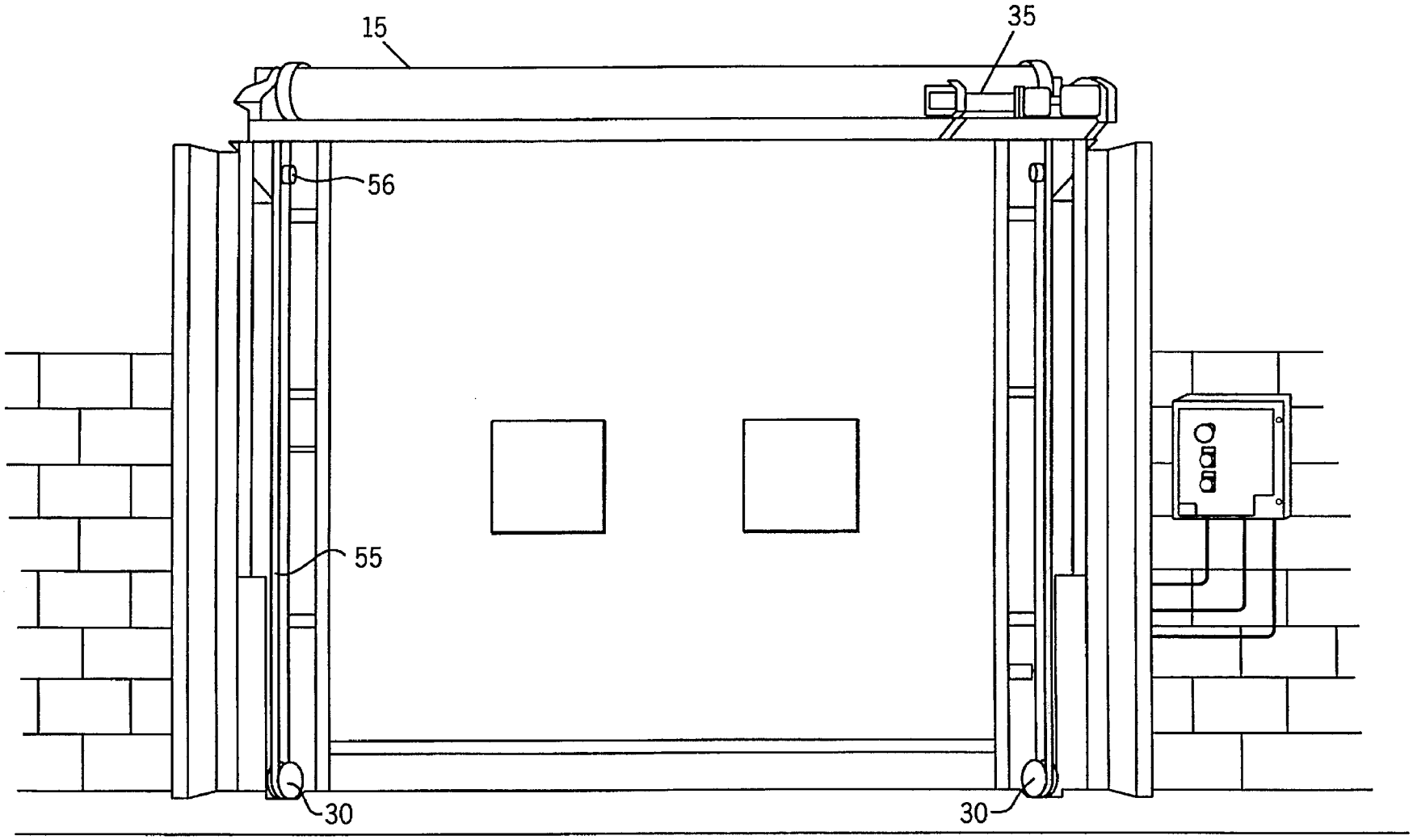
FIG. 2 is a further elevation of the door of FIG. 1.
Figure 3:
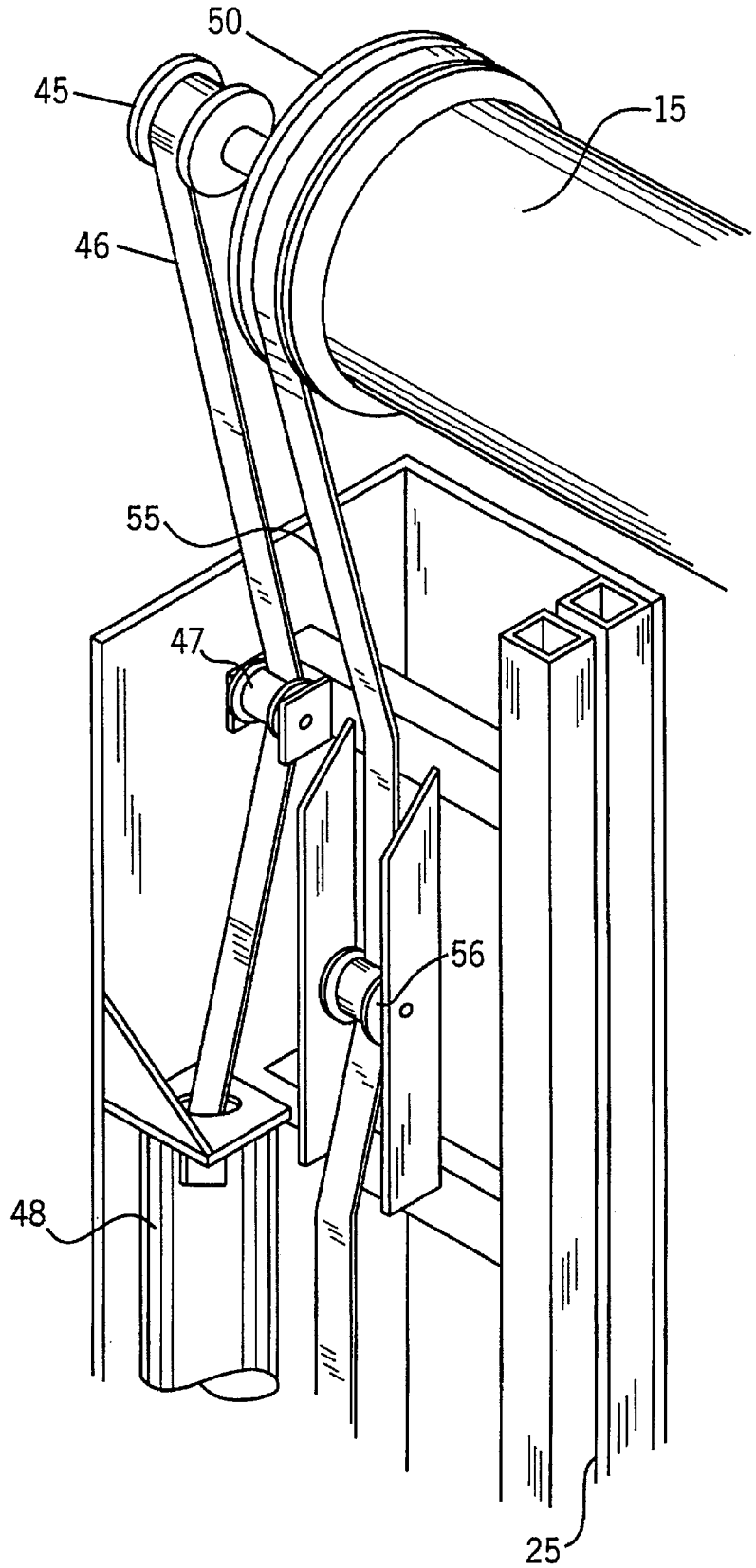
FIG. 3 is a perspective view of internal components of a door employing a tensioning assembly according to the invention.

An exemplary roller door employing the tension assembly according to the invention is shown in FIG. 1. The door 10 includes a curtain 12 which is windable on and off a roller 15 illustratively housed within a header assembly 16. The perspective view of FIG. 2 shows a view of the door with header 16 removed, thus revealing roller 15. Roller 15 is journaled for rotation above the doorway, the doorway being blocked and unblocked by the curtain 12. Vertical side frames 20 and 22 are disposed on either side of the doorway. The side frames typically include a slot for receiving and guiding an edge of the curtain in a vertical plane. The curtain slot 25 is seen in greater detail in the view of FIG. 3. According to a preferred embodiment of the invention, curtain slot 25 also receives, and guides in a vertical plane, a breakaway bottom bar insert member to be discussed in greater detail below. In this embodiment, the roller is actuated by a motor 35 disposed in the header and shown in FIG. 2. Actuation of the motor 35 rolls curtain 12 onto and off of roller 15 for the purpose of blocking and unblocking the doorway associated with door. The present embodiment includes a counter-balance mechanism for compensating the added torque necessary for turning the roller 15 as curtain 12 is rolled onto the roller. The counter-balancing mechanism is seen most clearly in FIG. 3. A small take-up pulley 45 is mounted on the shaft of the roller 15 for rotation therewith. A belt 46 has one end secured to the pulley 45, and winds onto pulley 45 in an opposite sense to the direction of winding of the curtain 12 onto the roller 15. Belt 46 then passes behind an idler pulley 47 and enters a counter-balance tube 48 disposed within the side frame. Counter-balance tube 48, in turn, houses a spring to which belt 46 is attached for the purpose applying a counter-balancing force to roller 15. Further details of this counter-balancing mechanism can be seen in U.S. Pat. No. 5,353,859 assigned to the assignee of the present application.

To provide for tensioning of curtain 12 both during travel of the door and with the door in the blocking position, a tensioning assembly is provided. The tensioning assembly includes a drum 50 mounted for rotation with the roller 15. A resilient member in the form of stretchable belt 55 has one end attached to the drum 50, and winds on the drum 50 in an opposite sense to the direction that curtain 12 winds onto the roller 15. While the resilient member in this embodiment is stretchable belt 55, other resilient, stretchable members could be used such as stretchable cables and the like. Further, while a separate drum 50 has been shown, it is not necessary to employ a separate drum. Rather, the stretchable belt may be wound directly on a portion of the roller separated from the portion of the roller occupied by the curtain. For either arrangement, the belt 55 will be referred to herein as being wound on a "drum". Belt 55 preferably passes behind an idler roller 56 disposed in the side frame. As can be seen in FIG. 2, pulleys 30 are disposed adjacent the floor 5 above which the doorway being blocked and unblocked by the door is disposed. Pulleys 30 provide a bearing surface around which stretchable belt 55 turns intermediate its two ends. The invention is not limited to pulleys, however, and other bearing surfaces, including rotatable, stationary, etc., could also be used. Each pulley 30 is also disposed adjacent to a vertical edge of the curtain in the closed position. Although pulleys 30 in the present embodiment are attached to the side frame, they need not be, and attachment to the floor or other structures is possible. Belt 55 passes around the pulley 30, and has a second end which is attached to the leading edge of the curtain. It will be appreciated that a tensioning assembly according to the invention may be provided on one or both sides of the curtain 12. As can be seen in FIG. 2, in the present embodiment, tensioning assemblies are provided on both sides of the door.

Figure 4:
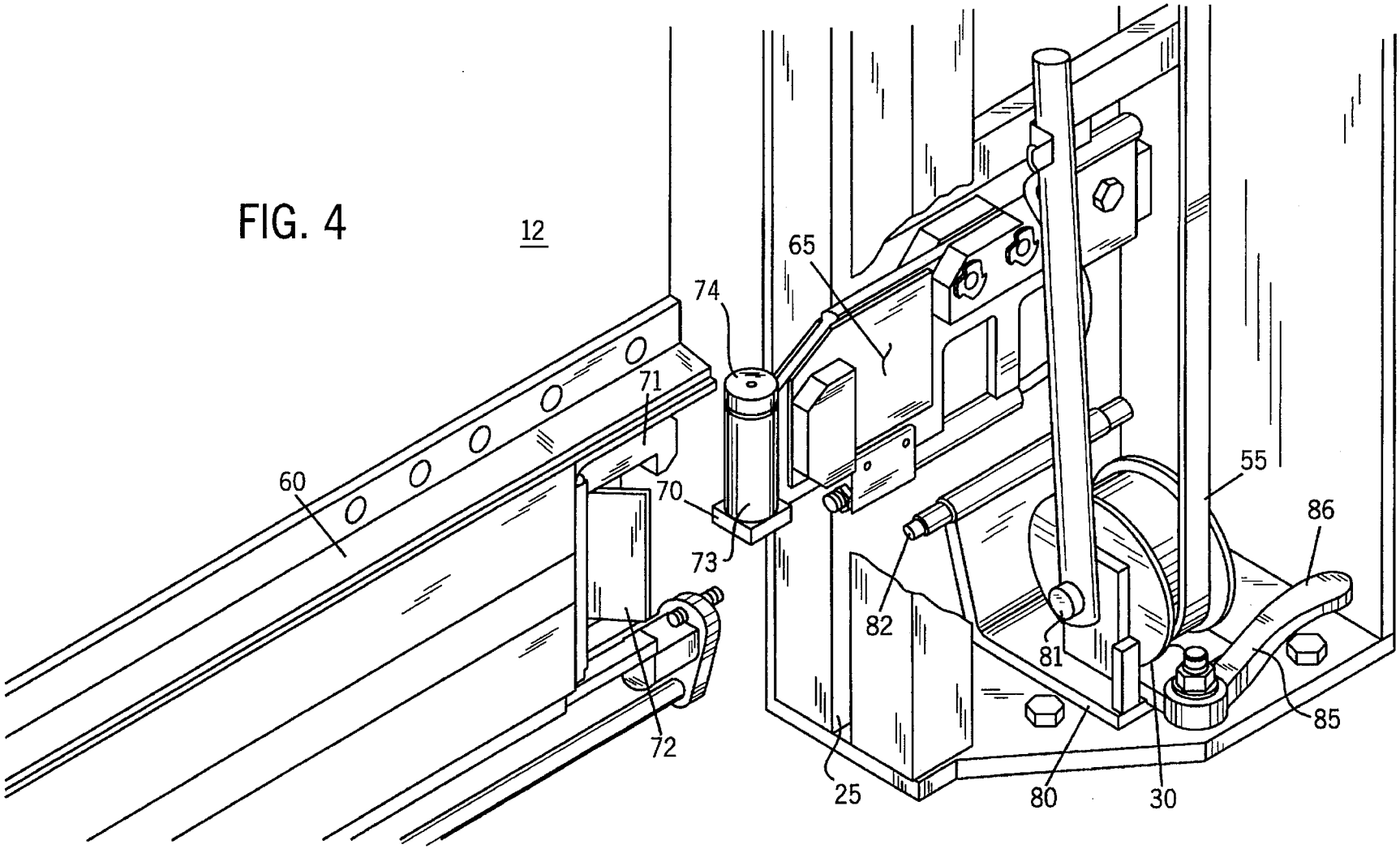
FIG. 4 is a perspective view of the movable pulley according to a preferred embodiment of the invention.

According to the present embodiment, the second end of belt 55 is attached to the leading edge of the curtain 12 through a breakaway bottom bar assembly. A breakaway bottom bar typically provides separation between a bottom bar and a side frame insert when the bottom bar is struck with sufficient force, such as by being struck by a forklift. Such an assembly is shown generally in FIG. 4. Curtain 12 includes a bottom bar 60 along its leading edge. This bottom bar provides stiffness across the leading edge of the door. Additionally, bottom bar 60 includes a breakaway connection to a side-frame insert 65. Side-frame insert 65 extends through the curtain slot 25 provided in the side frame. Further, the second end of the stretchable belt 55 is secured to this insert. Although that attachment is hidden from view in FIG. 4, it can be seen more clearly in FIG. 7 as indicated by reference numeral 57.

Returning to FIG. 4, the side-frame insert 65 is attached to the bottom bar 60 by means of a breakaway connection indicated generally by reference numeral 70. Although a variety of breakaway mechanisms may be used (if the tensioning assembly of the present invention is used in a door including breakaway), mechanism 70 shows a presently preferred embodiment. This embodiment includes a hook 71 and rotatable cup 72 disposed on bottom bar 60, and a post 73 including a cam follower 74 disposed on the side-frame insert. As the breakaway mechanism employed does not form a part of the invention, it will not be discussed in greater detail herein. Moreover, it should be noted that a breakaway assembly is not necessary to use of the tensioning assembly according to the present invention. Rather, in this embodiment, the breakaway connection between side-frame insert 65 and bottom bar 60 provides the means by which the second end of stretchable belt 55 is secured to the leading edge of the door. In alternative embodiments, the second end of stretchable belt 55 could be attached directly to the leading edge of the curtain, or to other components besides breakaway mechanisms attached to that leading edge. Further, the second end of stretchable belt 55 could be attached at other vertical positions along the curtain besides the leading edge. If that is the case, the pulley 30 may be located at a different height along the side frame rather than adjacent the floor. All that is required for the purpose of using the tensioning assembly according to the invention is that a second end of the belt be attached to the curtain. It will be appreciated by one skilled in the art that the "leading edge" of the curtain may or may not include components such as bottom bars, or sensor components mounted to the leading edge for the purpose of detecting obstacles to travel of the door.

The desired tension is imparted on stretchable belt 55, and thus also imparted on curtain 12 to which stretchable belt 55 is attached, by proper dimensioning of drum 50 and stretchable belt 55 relative to the radius of roller 15 and the thickness of the curtain 12. That is, the diameter of the drum 50 and the thickness of the stretchable belt 55 are selected relative to roller 15 and curtain 12 such that the stretchable belt 55 is always maintained under a proportional stretch for all vertical positions of the door between its blocking and unblocking positions. It will be appreciated that rollers and curtains of different radii and thickness will be used for different installations. To insure proper tensioning of the curtain according to the invention the relative dimensions of the curtain, roller, stretchable belt and drum must be properly chosen. Since curtain thickness and drum radius are typically dictated by the installation, proper selection of the relative dimensions of the four components (curtain, roller, drum and stretchable belt) will be referred to herein as dimensioning the drum and stretchable belt relative to the roller and curtain. Since stretchable belt 55 is maintained in a proportional stretch for all these vertical positions at the door, the curtain 12 is also maintained under tension for all of these vertical positions. Accordingly, the tensioning assembly according to the invention maintains curtain 12 under tension without the need for external moving or spring-loaded components acting on the belt as in previously-existing devices.

Figure 5:
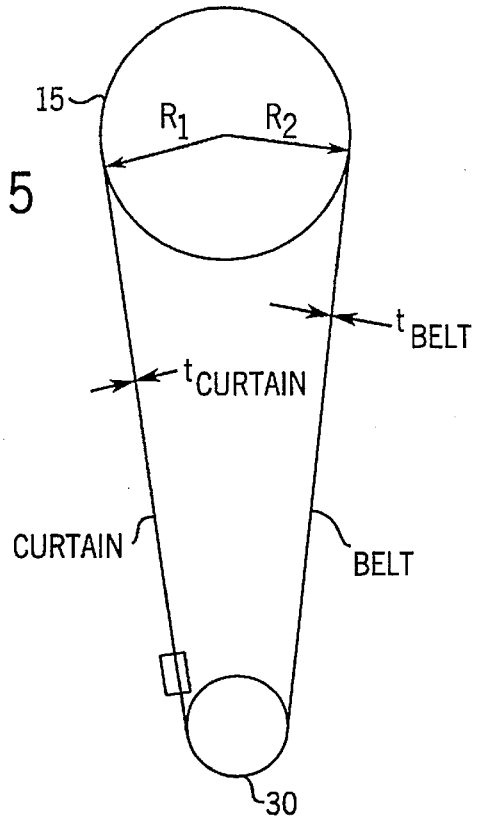
FIG. 5 is a conceptual drawing showing dimensions of the roller, curtain, drum and belt according to an embodiment of the invention.

Use of the simple tensioning assembly according to the invention is made possible by virtue of increases and decreases in the circumference of 1) the roller and accumulated curtain, and 2) the drum and accumulated stretchable belt. A simplified numerical example can be understood with reference to FIG. 5 which assumes equal radii for the curtain roller 15 and stretchable belt drum 50. The roller radius is labeled $R_1$ and the drum radius $R_2$. FIG. 5 also shows the thickness of the belt, represented by $t_{belt}$ (abbreviated "$t_b$" herein), the thickness of the curtain as at $t_{curtain}$ (abbreviated "$t_c$"). Bottom pulley 30 is also shown. As the curtain rolls up onto the roller 15, for each revolution of the roller, the radius of the roller and rolled-up curtain increases by one curtain thickness. Accordingly, as the curtain rolls up, the circumference of the curtain on the roller increases (for each full revolution) accordingly to the following progression: $2\pi(R_1)$; $2\pi(R_1+t_c)$; $2\pi(R_1+2t_c)$. At the same time stretchable belt 55 is unwinding from drum 50. Accordingly, the total circumference of the drum 50 and rolled stretchable belt 55 varies according to the following progression (assuming the fully-rolled-up belt has 2 thicknesses rolled onto the roller): $2\pi(R_2+2t_b)$; $2\pi(R_2+t_b)$; $2\pi(R_2)$. For each position of the door, a difference $\Delta$ may be defined. This length difference is the difference between the circumference of the curtain roller 15 and accumulated curtain, and the circumference of the stretchable belt drum 50 and accumulated stretchable belt 55. For any non-zero value of $\Delta$, stretchable belt 55 will be in a stretched condition. If $\Delta$ is defined as the curtain circumference minus the belt circumference, a negative $\Delta$ represents more belting wound on the drum than wound on the curtain (as is the case in the closed position of the door), a positive $\Delta$ indicates more curtain wound on the roller 15 than belting 55 wound on drum 50 (as is the case in the open position).

According to the invention, the radius of the drum 50 and the thickness of the stretchable belt 55 (relative to the dimensions of roller 15 and curtain 12) are chosen to ensure that a proportional stretch is maintained on stretchable belt 55 for all positions of the curtain 15. A proportional stretch means that the belt is being stretched within its proportional limit. The term "proportional limit" will be known to those skilled in the art, and represents a stretching of the stretchable belt 55 that obeys Hooke's law of proportionality that the force on a spring is equal to a constant times (the so-called "spring constant") the amount the spring is displaced ($F=kx$). Belts and other resilient members have a proportional limit beyond which they cannot be stretched and still maintain proportionality. That is, if a belt is stretched beyond its proportional limit and then released, it will not return to its unstretched length. Accordingly, the amount by which stretchable belt 55 is stretched divided by the unstretched length of stretchable belt 55 must be less than the proportional limit which is typically expressed as a percentage.

Since the relative radii of curtain 12 on roller 15 and stretchable belt 55 on drum 50 will vary from a condition where the circumference of the curtain is greater than the circumference of the belt to a condition where the circumference of the belt is greater than the circumference of the curtain, it will be appreciated that the previously-defined $\Delta$ will vary between negative and positive values, and pass through zero during this variance. As discussed above, a $\Delta=0$ condition typically represents a no-load position wherein stretchable belt 55 is not stretched. However, since it is desired, according to the invention, to always maintain a proportional stretch on stretchable belt 55, stretchable belt 55 is pre-loaded so that it is maintained under tension, even at the $\Delta=0$ condition.

One method for pre-loading stretchable belt 55 is to shorten the belt. That is, the radius of drum 50 and thickness of stretchable belt 55 could be set relative to roller 15 and curtain 12, such that the door would have a $\Delta=0$ position somewhere in the range of travel of the door. The length of the belt could then be adjusted so as to ensure that the belt remains under proportional stretch even in the $\Delta=0$ position. Movement of the door curtain in either direction from the $\Delta=0$ position would also maintain the stretchable belt 55, and thus curtain 12, under tension.

According to the preferred embodiment, such pre-loading of stretchable belt 55 is achieved by making pulley 30 movable between a tension-release and tensioned position. For this purpose, and as seen most clearly in FIG. 4, pulley 30 is mounted on a release bracket 80 which is pivotable about a hinge 82. A rotatable latch 85 secures the release bracket 80 and bottom pulley in the tensioned position shown in FIG. 4. Pulley 80 may be moved to the tension release position by rotating latch handle 86 to disengage the latch 85 from the release bracket. This allows pulley 30 to rotate about hinge 82 to an elevated position.

With the movable pulley 30 just described, the drum 50 and stretchable belt 55 may be properly dimensioned, relative to the roller and curtain to always maintain belt 55 under proportional stretch. According to this embodiment, these dimensions are chosen such that the stretchable belt 55 has an un-loaded position when the curtain is approximately halfway between the blocking and unblocking positions, and with the movable pulley 30 in tension-release position. A pre-tension is then applied to the belt by moving pulley 30 into its tensioned position. As before, the amount of pre-tensioning applied to the belt must be carefully selected so as to ensure that the belt always stays within its proportional limit during all ranges of travel of the door.

This method for pre-tensioning stretchable belt 55 is particularly advantageous when the tensioning assembly according to the invention is used in combination with a breakaway bottom bar assembly. Following breakaway, the side-frame insert 65 must be moved to a vertical position that is the same as the bottom bar 60 for the purpose of reassembly of bottom bar 60 and insert 65. However, with pulley 30 in its tensioned position, a proportional stretch is maintained on stretchable belt 55 for all positions of the door, thus making movement of the side-frame insert 65 to a vertical position parallel to the bottom bar 60 difficult. The ability to release the tension on stretchable belt 55 by means of moving the pulley 30 the tension-release position allows re-assembly of the breakaway assembly to be more easily performed.

Figure 6:
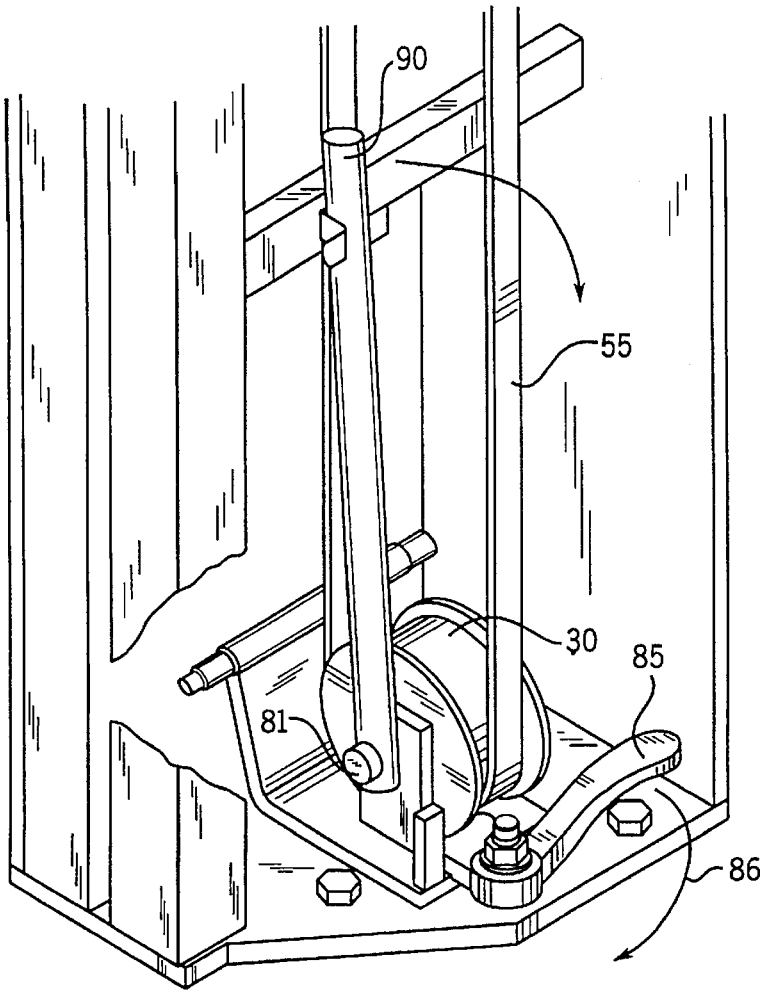
FIGS. 6–8 show a progression depicting the method for re-assembling a door employing the tensioning assembly of the invention, following breakaway.
Figure 7:
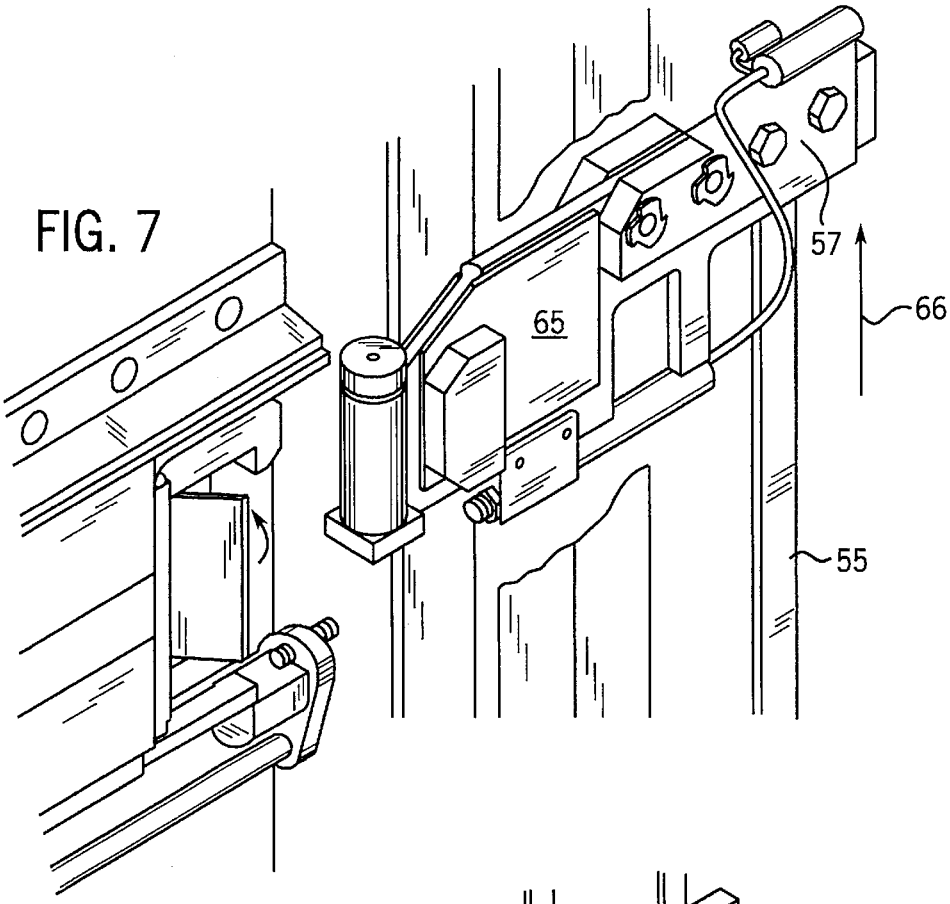
Figure 8:
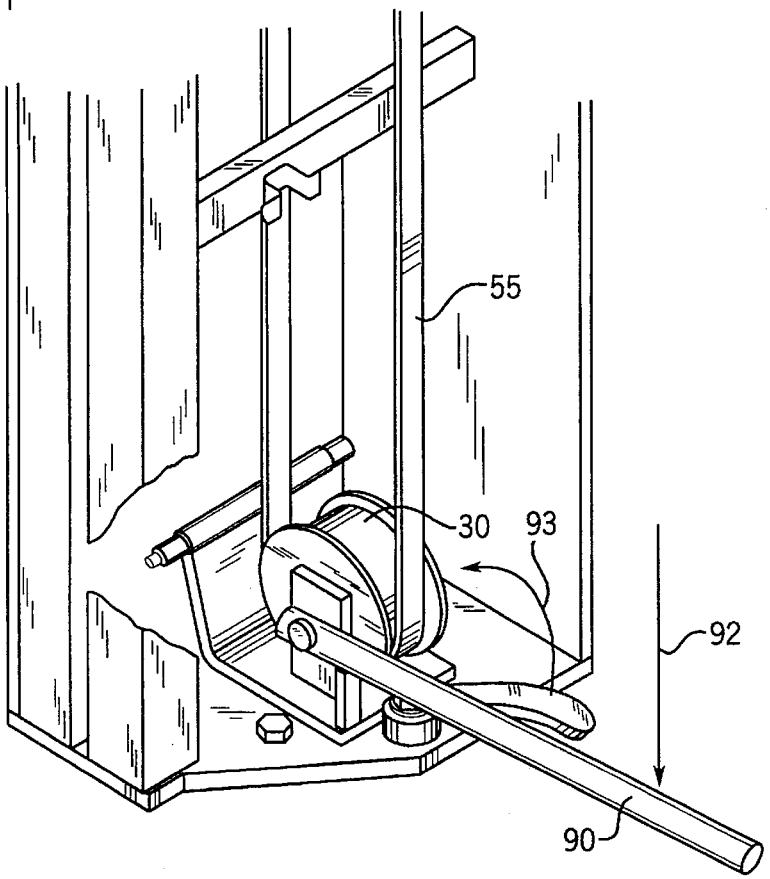

The steps for performing this re-assembly, as enhanced by the movable pulley according to the invention, are shown in FIGS. 6–8. As seen in FIG. 6, a fold-down lever 90 is attached to the spindle 81 upon which pulley 30 rotates. Handle 90 thus facilitates movement of pulley 30 between its tension-release and tensioned positions. Following breakaway, an operator may move the door to a mid-way position which has been previously determined to be the position where there is either a minimal or no-load on stretchable belt 55 when pulley 30 is in the tension-release position. Following movement of the door to this mid-way position, the latch 85 is rotated (see arrow 86) to allow the pulley 30 to move to the tension-release position. At this point, pulley 30 may be moved to the tension-release position by means of the handle 90. With the tension released from stretchable belt 55, the side-frame insert 65 may now be moved to a vertical position where it is parallel with the bottom bar 60, and the side-frame insert 65 (see arrow 66 in FIG. 7) and bottom bar then reattached. Following the reattachment, the pre-tensioning load is then re-applied to stretchable belt 55 (see FIG. 8) by pushing on handle 90 (arrow 92) to return pulley 30 to the tensioned position, where it is then secured in place by rotating latch 85 (arrow 93) to the secured position. Alternatively, the door could be designed to allow reassembly of the bottom bar at any vertical position of the door. In such an embodiment, pulley 30 must have a large enough range of travel to release the tension on the stretchable belt even when the door is not in a position at or near $\Delta=0$. Of course, if the pulley 30 is moved to a tension-release position when the stretchable belt 65 is at higher tension (such as with the door fully closed) a greater force must be exerted on the pulley to return it to the tensioned positioned as compared to doing so when the stretchable belt 55 is at a lower tension position (such as $\Delta=0$).

As has been mentioned, stretchable belt 55 must remain under a proportional stretch for the range of travel of the door. At the present time, the preferred belting for this purpose is a nylon belting manufactured in Europe by Habasit, and bearing model no. F-39. The preferred thickness of the belting is 0.10 inches, although other thicknesses may be used. This belting has a proportional limit of approximately 3½%. Of course, other stretchable belting could also be used, and fall within the scope of the present invention.

The requirement to maintain the stretchable belt 55 within the proportional limit may require a modified embodiment in tall roller doors. In tall doors (over about 12 feet), the proportional limit of existing belting is too small to allow the belt to be stretched for all positions of the curtain while staying within the proportional limit. Accordingly, the drum and belting on such doors must be dimensioned so as to provide a no-load position in the range of travel of the door, but without a pre-loading of the belt as in previous embodiments. To prevent the un-loaded belt from whipping during door travel, a spring-loaded idler pulley may be mounted adjacent the belt and disposed along the length of the belt to take up any slack in the belt resulting from little or no stretch of the belt. Even so, in such an embodiment, the stretchable belt would still be proportionally stretched (and the curtain thus tensioned) with the curtain in the blocking and unblocking positions, and at other points along the range of travel of the curtain.

There has thus been provided a tensioning assembly for a roller door which uses the natural resiliency of a stretchable belt combined with proper dimensioning of the belt and the drum to which it is attached for maintaining tension on the curtain for all positions of the curtain. By applying pre-load to a stretchable belt that would otherwise have a no-load position within the range of travel of the curtain, tension may be applied to the curtain for all positions. The invention is not intended to be limited by the above-described preferred embodiments, rather, it is intended to cover all such modifications and equivalents as would be apparent to one skilled in the art, and as fall within the spirit and scope of the appended claims.

What is claimed is:

1. A tensioning assembly for use on a roller door including a curtain of a given thickness windable on a roller of a given radius for selectively blocking and unblocking a doorway above a floor surface, the tensioning assembly comprising:

a drum attached to the roller for rotation therewith;

a bearing member disposed adjacent a vertical edge of the curtain in the doorway blocking position;

a resilient member having a first end connected to the drum and a second end connected to the curtain, the member passing around the bearing member intermediate its first and second ends, the member being windable on the drum in an opposite sense to the winding of the curtain on the roller;

the drum and resilient member being dimensioned relative to the roller and curtain to maintain proportional stretch on the member for all vertical positions of the curtain, the member having a no-load position, and being pre-loaded with a tension at the no-load position to maintain the proportional stretch on the member for all vertical positions of the curtain, the bearing member being movable between a tensioned position, wherein the belt is pre-loaded; and a tension-release position, wherein the belt is not pre-loaded.

2. The tensioning assembly of claim 1, wherein the bearing member is disposed on a release bracket that is pivotable to move the bearing member between the tensioned and tension-release positions.

3. A tensioning assembly for use on a roller door including a curtain of a given thickness windable on a roller of a given radius for selectively blocking and unblocking a doorway above a floor surface, the tensioning assembly comprising:

a drum attached to the roller for rotation therewith;

a bearing member disposed adjacent a vertical edge of the curtain in the doorway blocking position;

a stretchable belt having a first end connected to the dram and a second end connected to the curtain, the belt passing around the bearing member intermediate its first and second ends, the belt being windable on the drum in an opposite sense to the winding of the curtain on the roller;

the drum and belt being dimensioned relative to the roller and curtain to maintain proportional stretch on the belt for all vertical positions of the curtain, whereby the curtain is maintained under tension.

4. A tensioning assembly for use on a roller door including a curtain of a given thickness windable on a roller of a given radius for selectively blocking and unblocking a doorway above a floor surface, the tensioning assembly comprising:

a drum attached to the roller for rotation therewith;

a bearing member disposed adjacent a vertical edge of the curtain in the doorway blocking position;

a resilient member having a first end connected to the drum and a second end connected to a leading edge of the curtain, the member passing around the bearing member intermediate its first and second ends, the member being windable on the drum in an opposite sense to the winding of the curtain on the roller;

the dram and resilient member being dimensioned relative to the roller and curtain to maintain proportional stretch on the member for at least the blocking and unblocking positions of the curtain, the member having a no-load position, and being pre-loaded with a tension at the no-load position to maintain the proportional stretch on the member for at least the blocking and unblocking positions of the curtain, the bearing member being movable between a tensioned position, wherein the belt is pre-loaded; and a tension-release position, wherein the belt is not pre-loaded.

5. A tensioning assembly for use on a roller door including a curtain of a given thickness windable on a roller of a given radius for selectively blocking and unblocking a doorway above a floor surface, the tensioning assembly comprising:

a drum attached to the roller for rotation therewith;

a bearing member disposed adjacent a vertical edge of the curtain in the doorway blocking position;

a stretchable belt having a first end connected to the drum and a second end connected to the curtain, the belt passing around the bearing member intermediate its first and second ends, the belt being windable on the drum in an opposite sense to the winding of the curtain on the roller;

the drum and belt being dimensioned relative to the roller and curtain to maintain proportional stretch on the belt for at least the blocking and unblocking positions of the curtain, whereby the curtain is maintained under tension.

* * * * *